US008678425B2

(12) United States Patent
Schaaper et al.

(10) Patent No.: US 8,678,425 B2
(45) Date of Patent: Mar. 25, 2014

(54) ROLLATOR WHEELCHAIR

(75) Inventors: Martijn Schaaper, Monster (NL); Bauke Jan Bokma de Boer, Wassenaar (NL); Hugo van de Watering, The Hague (NL)

(73) Assignee: BOBErgo B.V., Den Haag (NL)

( * ) Notice: Subject to any disclaimer, the term of this patent is extended or adjusted under 35 U.S.C. 154(b) by 0 days.

(21) Appl. No.: 13/496,050

(22) PCT Filed: Sep. 17, 2010

(86) PCT No.: PCT/NL2010/050602

§ 371 (c)(1),
(2), (4) Date: Jun. 28, 2012

(87) PCT Pub. No.: WO2011/034427

PCT Pub. Date: Mar. 24, 2011

(65) Prior Publication Data

US 2012/0256384 A1 Oct. 11, 2012

(30) Foreign Application Priority Data

Sep. 17, 2009 (NL) ..... 2003506

(51) Int. Cl.
*B62B 1/00* (2006.01)

(52) U.S. Cl.
USPC ..... 280/648; 280/650; 280/42; 280/647; 280/87.05; 280/47.38; 297/5; 135/67

(58) Field of Classification Search
USPC ..... 280/47.24, 47.25, 87.021, 87.05, 242, 280/250.1, 242.1, 30, 649, 650, 639, 42, 280/647, 648, 47.4, 1.5, 200, 304.1; 297/5–6, DIG. 4, 485; 482/65–69
See application file for complete search history.

(56) References Cited

U.S. PATENT DOCUMENTS

| | | | | |
|---|---|---|---|---|
| 5,050,899 | A * | 9/1991 | Stensby | 280/250.1 |
| 6,338,493 | B1 * | 1/2002 | Wohlgemuth et al. | 280/30 |
| 6,694,548 | B2 * | 2/2004 | Foster et al. | 5/600 |
| 2003/0151232 | A1 | 8/2003 | Li | |
| 2007/0267835 | A1 | 11/2007 | Huang | |

(Continued)

FOREIGN PATENT DOCUMENTS

| | | |
|---|---|---|
| CN | 2571350 Y | 9/2003 |
| CN | 2574667 Y | 9/2003 |

(Continued)

OTHER PUBLICATIONS

International Search Report for PCT/NL2010/050602, mailed Dec. 6, 2010.

*Primary Examiner* — John Walters
*Assistant Examiner* — James Triggs
(74) *Attorney, Agent, or Firm* — Waddey Patterson PC; Rebecca M. Barnett

(57) ABSTRACT

A rollator wheelchair is provided comprising a frame provided with at least two wheels, a first chair section mounted to the frame and a second chair section mounted to the frame, the first chair section comprising a back support and a first seat portion, and the second chair section comprising a second seat portion, wherein the first and second chair sections provide a seating arrangement, wherein the first chair section is detachable and wherein the second chair is arranged such that when the first chair section is detached a free walking space is present between the at least two wheels.

6 Claims, 13 Drawing Sheets

(56) References Cited

U.S. PATENT DOCUMENTS

| | | | | |
|---|---|---|---|---|
| 2008/0121258 | A1 | 5/2008 | Lin | |
| 2009/0194373 | A1* | 8/2009 | Liljedahl | 188/24.21 |
| 2011/0193305 | A1* | 8/2011 | Li | 280/47.34 |

FOREIGN PATENT DOCUMENTS

| | | | |
|---|---|---|---|
| CN | 101224155 | A | 7/2008 |
| EP | 1145696 | | 10/2001 |
| WO | 9531169 | | 11/1995 |

* cited by examiner

ROLLATOR WHEELCHAIR

FIELD AND BACKGROUND OF THE INVENTION

The invention relates to a rollator-wheelchair combination.

Rollators are commonly known and are used by people experiencing difficulties with walking, due to e.g. physical disabilities. Such devices enable a handicapped person to go for a walk on their own and allow them to travel from one place to the other. Usually, such rollators are provided with a small board to allow the handicapped person to sit on and rest for a while. When walking for a longer time period or a larger distance, the handicapped person may get tired and might want to rest for a long period or may want to be pushed in a wheel chair.

When walking with a companion, rollator wheelchair combinations provide the possibility for the handicapped person to walk a while with the rollator wheelchair combination in its rollator position, and when getting e.g. too tired the rollator wheelchair combination can be changed in its wheelchair position. The person can then rest in the seat of the rollator wheelchair combination, while the companion pushes the rollator wheelchair combination, allowing them to travel further along together.

However, such rollator wheelchair combinations are usually permanently equipped with all the features of both the rollator and the wheelchair, such as footrests and a chair with a seat and a back support, which may make the rollator wheelchair combination relatively heavy. Also, handles are needed that can accommodate a person leaning when used as a rollator, as well as a person pushing when used as a wheelchair. Furthermore, a person leaning on the device when used as a rollator assumes a position between the wheels of the rollator, whereas a person pushing the device when used as a wheelchair assumes a position behind the device. Accordingly, a rollator wheelchair combination is required to provide both positions, without impeding either functions of the rollator wheelchair combination.

SUMMARY OF THE INVENTION

It is an object of the present invention to provide a rollator wheelchair combination that can easily be converted between a condition for performing a rollator function and a condition for performing a wheelchair function.

According to the invention, this object is achieved by providing a rollator wheelchair according to claim 1.

By providing a rollator wheelchair comprising a frame provided with at least two wheels, a first chair section mounted to the frame and a second chair section mounted to the frame, the first chair section comprising a back support and a first seat portion, and the second chair section comprising a second seat portion, wherein the first and second chair sections provide a seating arrangement, wherein the first chair section is detachable and wherein the second chair is arranged such that when the first chair section is detached a free walking space is present between the at least two wheels, allows conversion between two modes of operation. In a first mode of operation as a rollator a person can stand between the at least two wheels and lean on the rollator wheelchair combination. In a second mode of operation as a wheelchair a person can sit while another person pushes the rollator wheelchair combination.

Particular embodiments of the invention are set forth in the dependent claims.

Also the hinge construction allowing the rollator wheelchair combination to fold and unfold, can be seen as an invention. Thereto is provided two swivelling arms that are crosswise provided between two similar shaped profile sections, wherein the profile sections are provided with a hinge and a catching stop, wherein each swivelling arm at an end is connected with the hinge of one profile section and at an other end is connected with the catching stop of the other profile section, and wherein the swivelling arms are centrally connected to each other with a connection hinge, for folding the two profile section to each other and unfolding the profile section at a certain distance from each other. The rollator wheelchair combination can thus be easily and reliably folded and unfolded. Preferably, the swivelling arms are approximately horizontally oriented when the rollator wheelchair combination is in a use mode, e.g. a rollator mode or a wheelchair mode.

Further, the connection of the footrest on the frame of the rollator wheelchair combination can be seen as an invention. Thereto, there is provided a footrest comprising an attachment element and an arm with a board, wherein the attachment element comprises two jaw members which are operable by a pressing mechanism to a spread position and which are movable towards each other by operation of the pressing mechanism into a release position, wherein the inner sides of the jaw members are adapted to the dimensions of profile sections of a frame of a rollator wheelchair combination, wherein each jaw member is provided with two recesses for receiving a pin. The footrest can thus be easily and reliably be connected and disconnected from the profile sections of the frame of the rollator wheelchair combination.

Further, the profiles of the frame of the rollator wheelchair combination can be seen as an invention. Thereto is provided a profile section comprising at least one hollow portion extending along the longitudinal direction of the profile section, in which hollow portion at least one stop ridge is provided which is shaped to allow a nut to fit tightly in a mounting groove. Bolts and/or nuts can thus be easily attached to the profile section.

Further objects, features, effects and details of the invention are described below.

DETAILED DESCRIPTION

Figure 1:
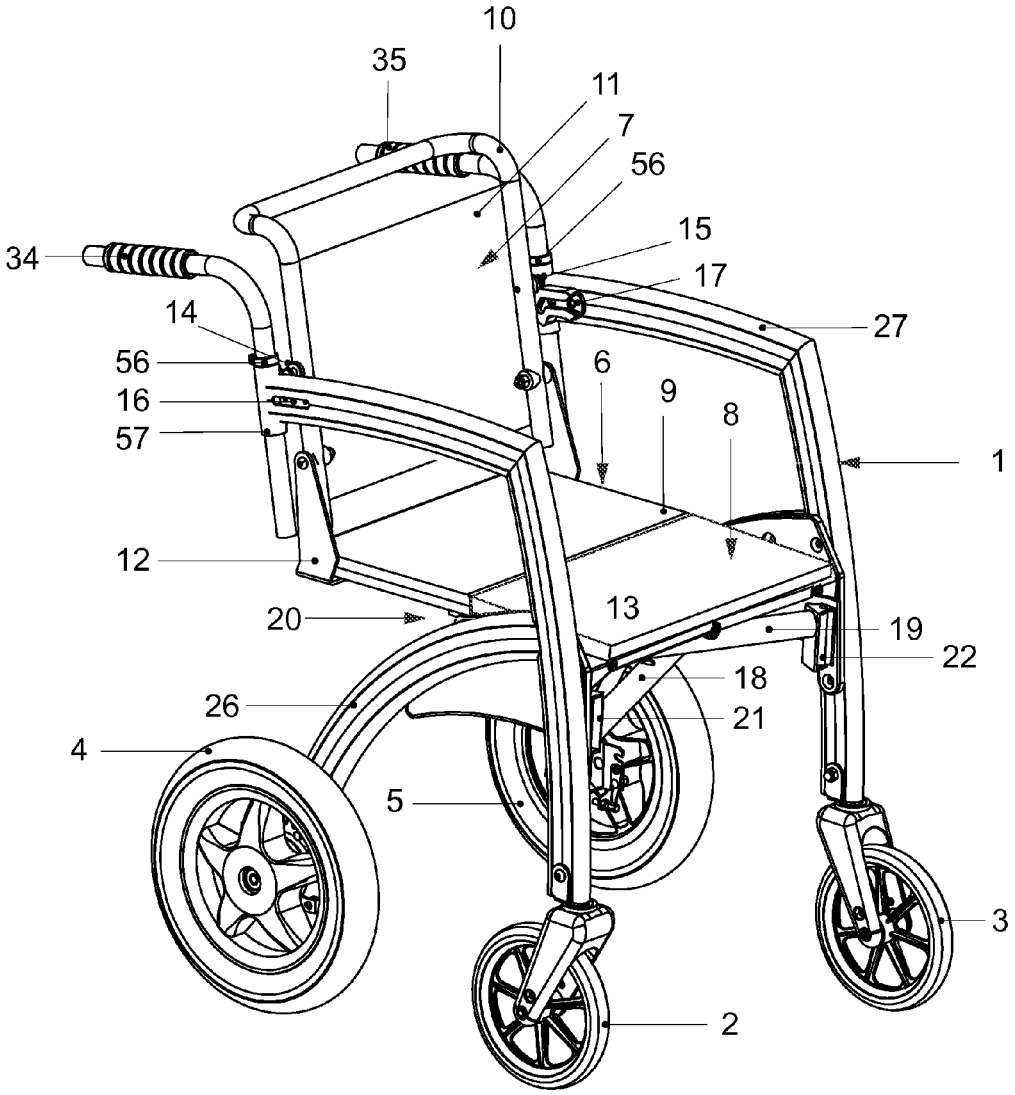
FIG. 1 is a perspective view of an example of a rollator wheelchair according to the invention.

A rollator wheelchair, shown in FIG. 1, has a frame 1 provided with at set of front wheels 2, 3, a set of rear wheels 4, 5 and a set of handles 34, 35. A seating arrangement 6 is constructed by a first chair section 7 and a second chair section 8. The first chair section 7 has a back frame 10 carrying back support 11 that is hingingly connected to a seat frame 12 carrying a first seat portion 9. The second chair section 8 has a collapsible second seat portion 13.

Figure 2:
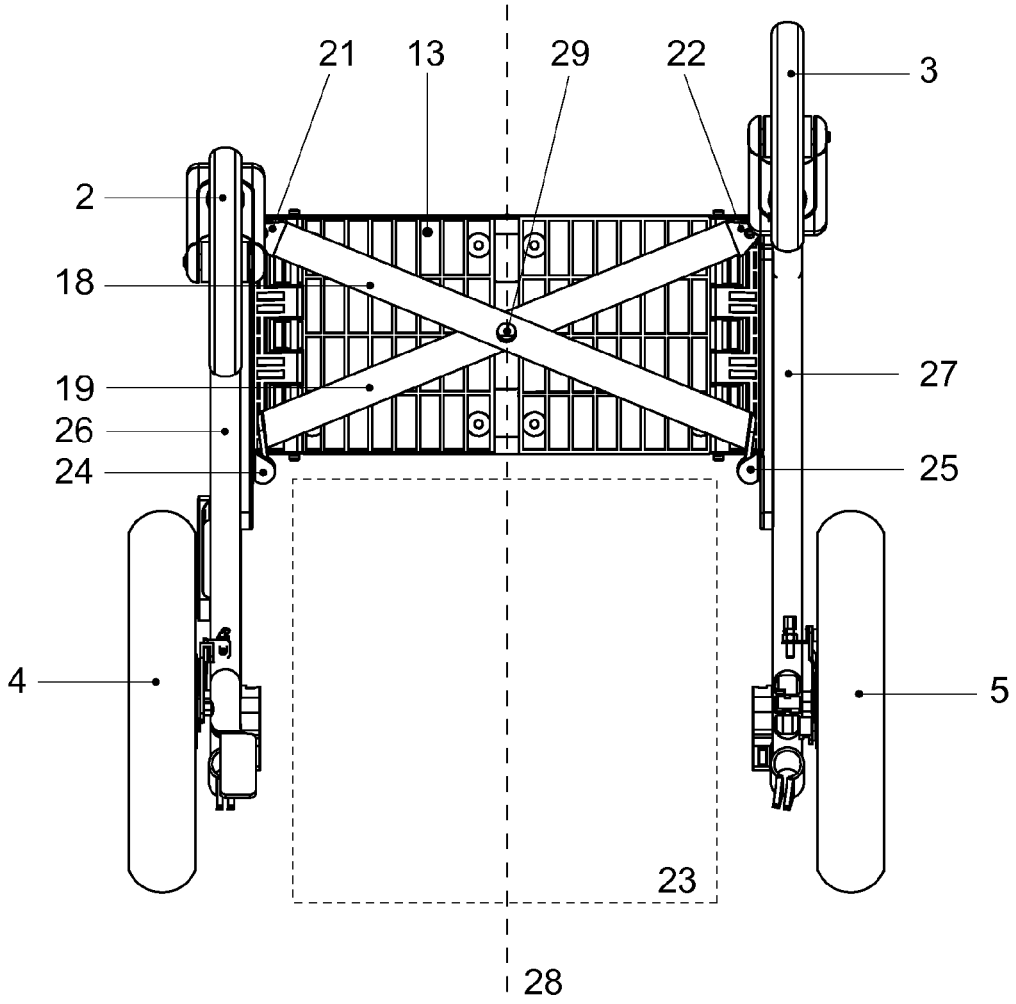
FIG. 2 is a bottom view of the rollator wheelchair of FIG. 1.

The back frame 10 is provided with two rollers 14, 15 that slide into guiding rails 16, 17 respectively mounted on a right side and a left side of the frame 1. The seat frame 12 is supported at the front 20 by the frame 1. The first chair section 7 is detachable from the frame 1 by sliding the rollers 14, 15 out of the rails 16, 17 and lifting it from the frame 1. The second chair section 8 is arranged such that, when the first chair section 7 is detached, as shown in FIG. 2, a free walking space 23 is cleared. When this free walking space 23 is clear, the rollator wheelchair is in a first mode of operation as a rollator, wherein a person can stand between the rear wheels 4, 5, can lean on the handles 34, 35 and can find support from the rollator wheelchair combination.

Figure 3:
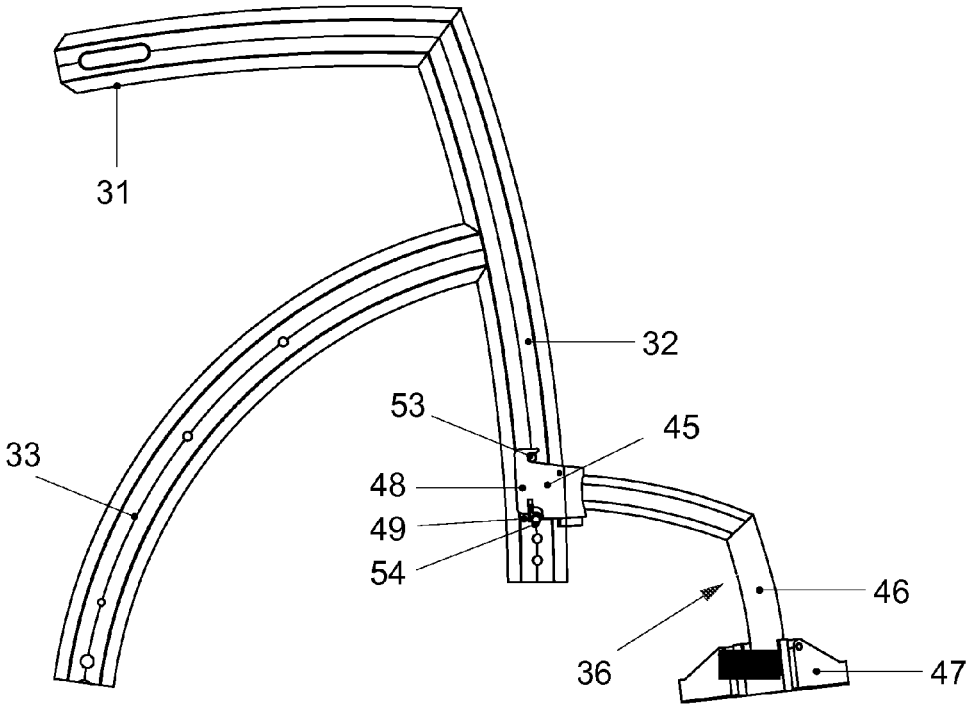
FIG. 3 is a side view of a profile section of the rollator wheelchair of FIG. 1 with a footrest

When the first chair section 7 is mounted in place, the rollator wheelchair is in a second mode of operation as a wheelchair. The frame 1 is constructed of two identical shaped profile sections 26, 27, as best seen in FIG. 3, and two swiveling arms 18, 19, as shown in FIG. 2. The profile sections 26, 27 are spaced apart from each other and placed symmetrically with respect to a centre plane 28, forming a left side profile section 27 and a right side profile section 26.

Figure 4:
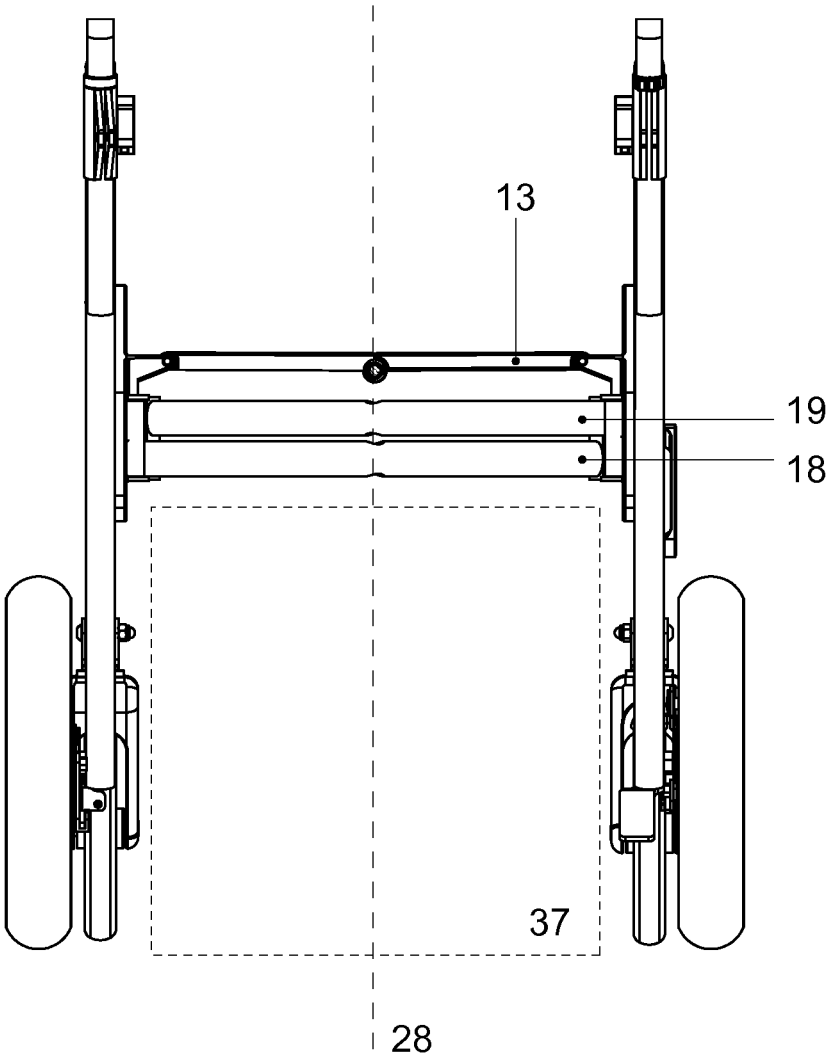
FIG. 4 is a front view of the rollator wheelchair of FIG. 1.

Each profile section 26, 27 has three arms 31, 32, 33 that provide attachment points for respectively a handle 34, 35, a front wheel 2, 3 and a rear wheel 4, 5. Furthermore, arm 32 is here provided with a footrest 36. Swiveling arm 18 is connected to the right profile section 26 with a hinge 21 and falls in a catching stop 25 of the left profile section 27. Swiveling arm 19 is connected to the left profile section 27 with a hinge 22 and falls in a catching stop 24 of the right profile section 26. The swiveling arms 18, 19 cross in the centre plane 28 at intersection 29 where they are connected by a joining hinge 30. As shown in FIG. 4, the height at which the swiveling arms 18, 19 and the seat portion 13 are arranged leaves a free legroom 37 allowing a seated person enough space to dangle the legs freely without touching the ground.

Figure 7:
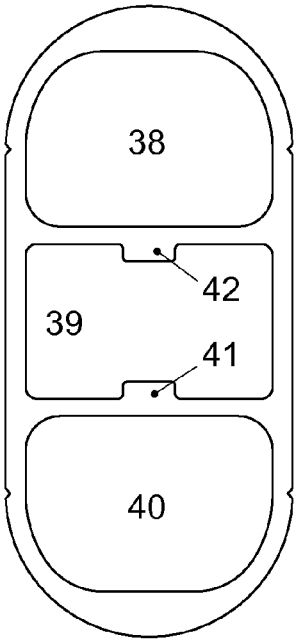
FIGS. 7 and 8 are a cross section of the profile section of FIG. 3.
Figure 8:
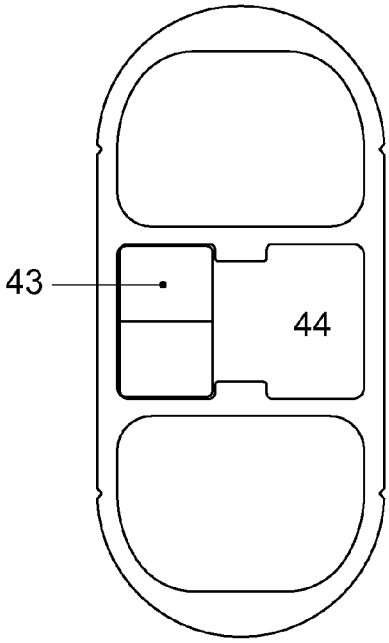

The profile sections 26, 27 are extruded from aluminum with hollow portions 38-40 extending along the longitudinal direction of the profile sections 26, 27, as shown in FIGS. 7 and 8. Hollow portion 39 is provided with two stop ridges 41, 42 and shaped such that a nut 43 fits tightly in a thus formed mounting groove 44. Preferably, the size of the mounting groove 44 is such that it accommodates an M8 nut of a nut and bolt combination. By drilling a hole in an accordingly extruded profile section, a bolt can be connected to the nut 43 present in the mounting groove 44.

Figure 5:
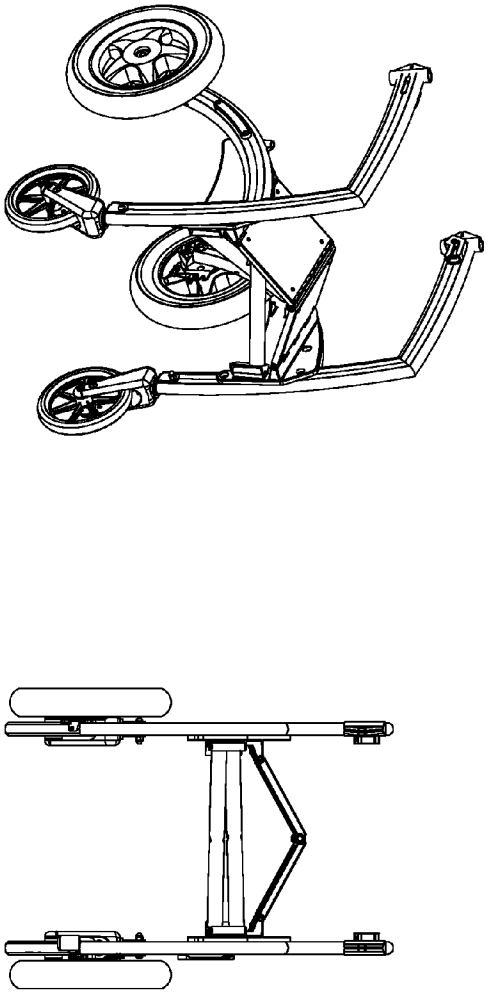
FIG. 5 shows the rollator wheelchair of FIG. 1 partially collapsed in a perspective view and a front view.
Figure 6:
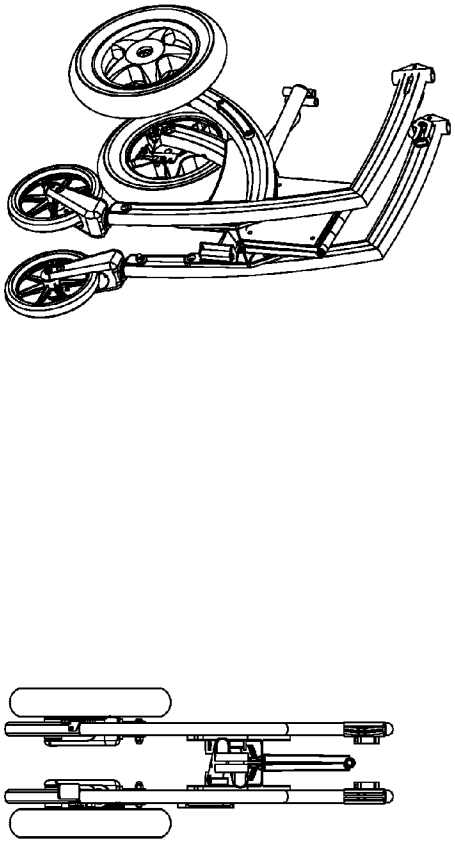
FIG. 6 shows the rollator wheelchair of FIG. 1 fully collapsed in a perspective view and a front view.

By releasing the swivelling arms 18, 19 from the catching stops 24, 25, the profile sections 26, 27 can be pushed towards each other, as shown in FIGS. 5, 6, forcing the collapsible second seat portion 13 to collapse. In the collapsed position of FIG. 6, the swivelling arms 18, 19 extend almost parallel along the centre plane 28. In this collapsed position the rollator wheelchair takes up less space allowing easy storage.

Figure 9:
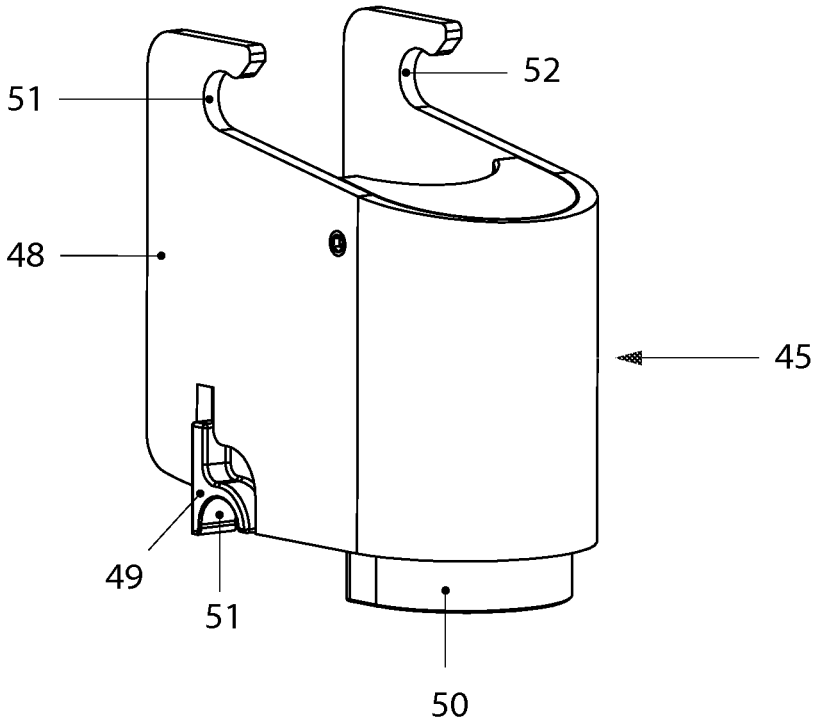
FIG. 9 is a perspective view of an attachment element of the footrest of FIG. 3.
Figure 10:
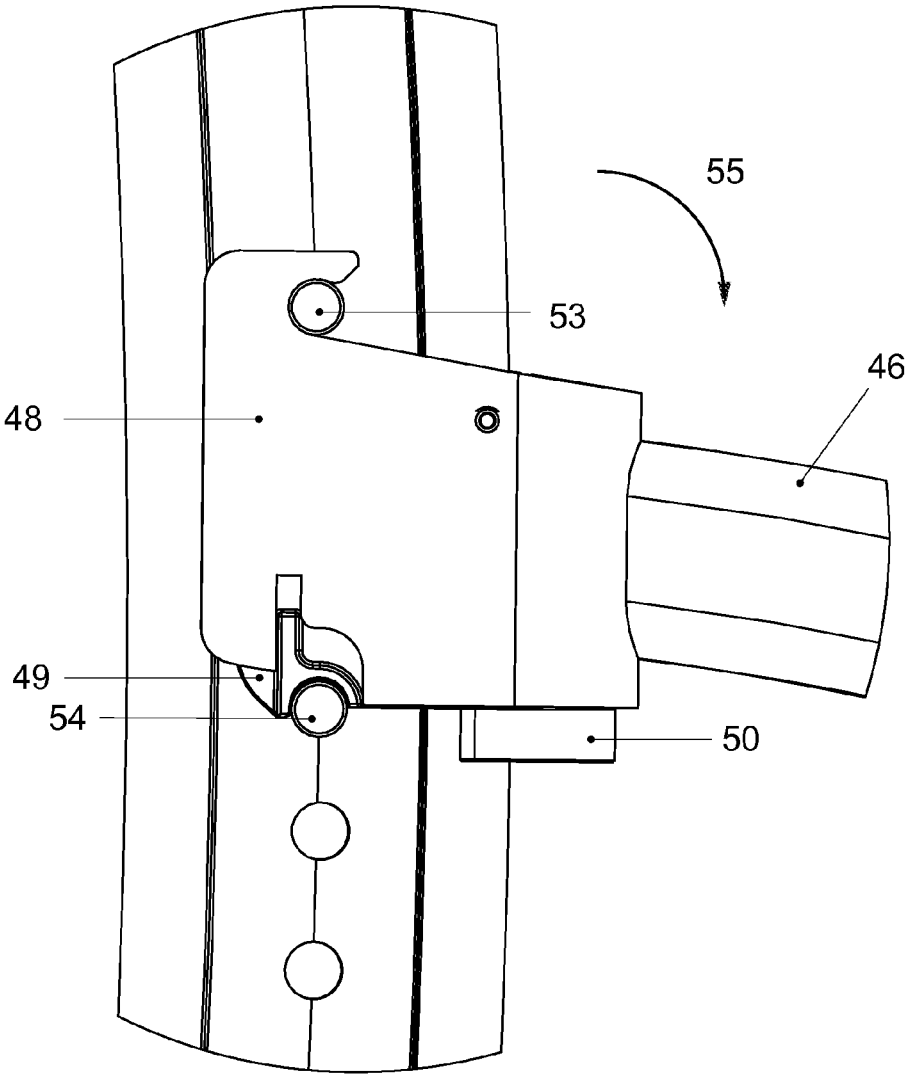
FIG. 10 is a cut-out side view of the attachment element of FIG. 9.

In order to fully function as a wheelchair, the rollator wheelchair is provided with footrests 36. The attachment thereof is an invention in its' own right, FIGS. 9, 10. A footrest 36 comprising an attachment element 45 and an arm 46 provided with a board 47; wherein the attachment element 45 comprises two jaw members 46, 47 which are pressed by a pressing-mechanism 50 in a spread position and which are movable towards each other by operation of the pressing-mechanism 50 into a release-position, and wherein each jaw member 48, 49 is provided with at least one recess 51, 52 for receiving a pin 53, 54. Furthermore, the inner sides of the jaw members 48, 49 are adapted to accommodate profile sections 26, 27. In this example each of the jaw members 48, 49 is further provided with a second recess 52 for receiving the pin 53, 54. The profile sections 26, 27 are pierced by pins 53, 54. Attachment of the footrest 36 is achieved by pushing the pressing-mechanism 50, placing recesses 51, 52 of jaw member 48 around pin 53, rotating the arm 46 of the footrest 36 in the direction of arrow 55, FIG. 10, till recesses 51, 52 of lower jaw member 49 are positioned behind pin 54 and releasing the pressing-mechanism 50. In this manner, the footrest 36 is attached and secured simple and direct.

Figure 11:
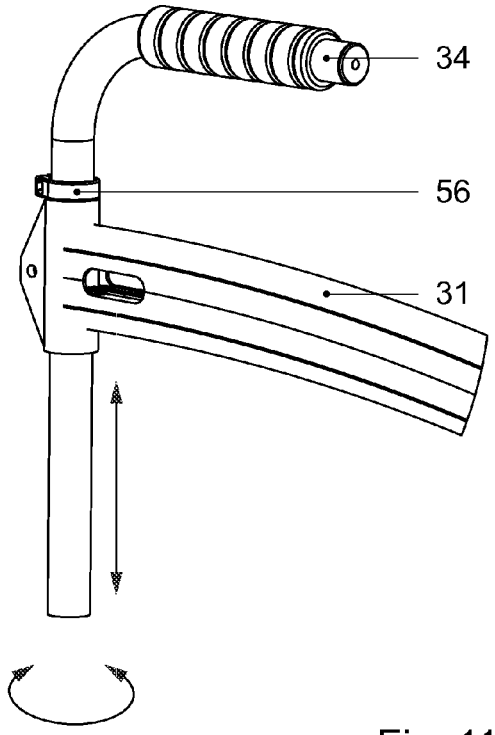
FIG. 11 is a perspective view of a handle in a rollator position.
Figure 12:
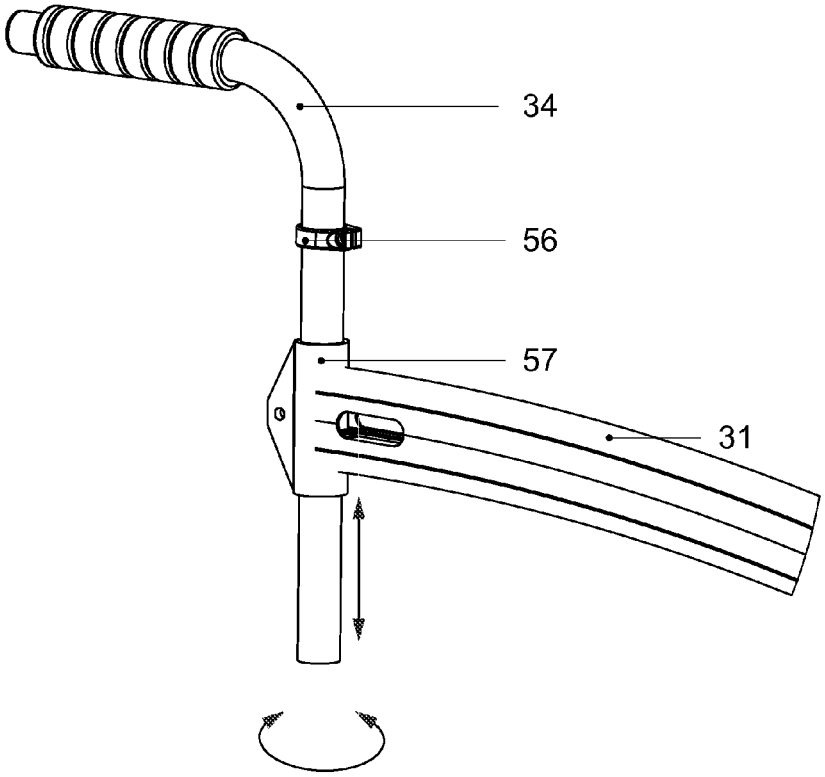
FIG. 12 is a perspective view of the handle of FIG. 11 in a wheelchair position.
Figure 13:
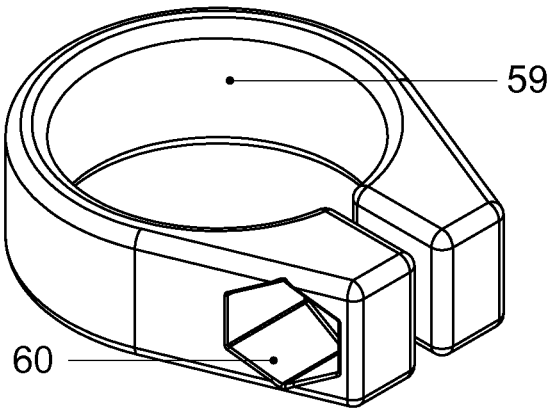
FIG. 13 is a perspective view of a clamp ring.
Figure 14:
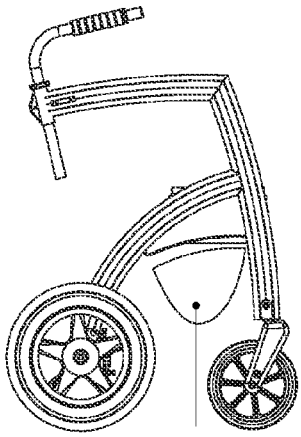
FIG. 14-16 are side views of the rollator wheelchair of FIG. 1 in different modes of operation.
Figure 15:
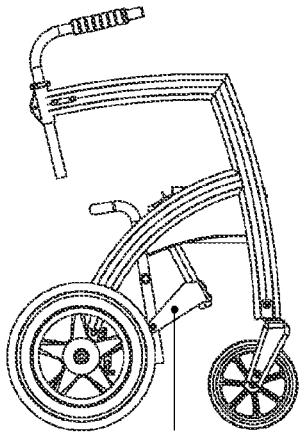
Figure 16:
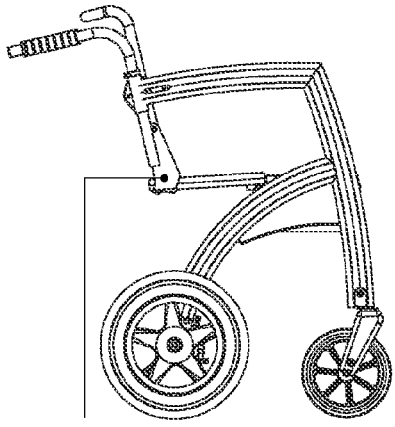

A further invention aimed at full conversion between a condition for performing a rollator function and a condition for performing a wheelchair function is the embodiment of the handles 34, 35. A handle 34, 35 bent in two directions perpendicular to each other, provided with a clamp ring 56. The handles 34, 35 in FIG. 16 are in a position for the wheelchair function and can be rotated to a position for the rollator, as shown in FIGS. 14 and 15. In FIG. 12, handle 34 is shown in close-up. The handle 34 is mounted in handle holder 57 of arm 31 of the profile section 26. The clamp ring 56 is positioned such that in the rollator position the handle 34 is at a comfortable height for a person using the rollator, as can be seen in FIGS. 11 and 12. This height is usually lower than the height preferred by a person pushing the wheelchair. The clamp ring 56 allows memorizing the preferred height of the handle 34 for the rollator function when the handle 34 is actually in the position for wheelchair function. The clamp ring 56 is shown in FIG. 13 in more detail with an opening 59 for receiving the handle 34, 35 and a recess 60 for receiving a nut of a nut and bolt combination. With the nut and bolt combination the clamp ring 56 is clamped to the handle 34, 35.

FIGS. 14, 15 and 16 show the rollator wheelchair combination in different modes of operation. FIG. 14 shows the rollator mode of operation wherein a bag 61 is provided, for example for storing shopping goods. FIG. 15 shows the rollator mode of operation wherein the seating arrangement 6 is in a stored position. And FIG. 16 shows the wheelchair mode of operation wherein the seating arrangement 6 is in a mounted position wherein a person seated on the rollator wheelchair combination can be pushed forward by a companion, the seated person facing the direction of travel.

Figure 17:
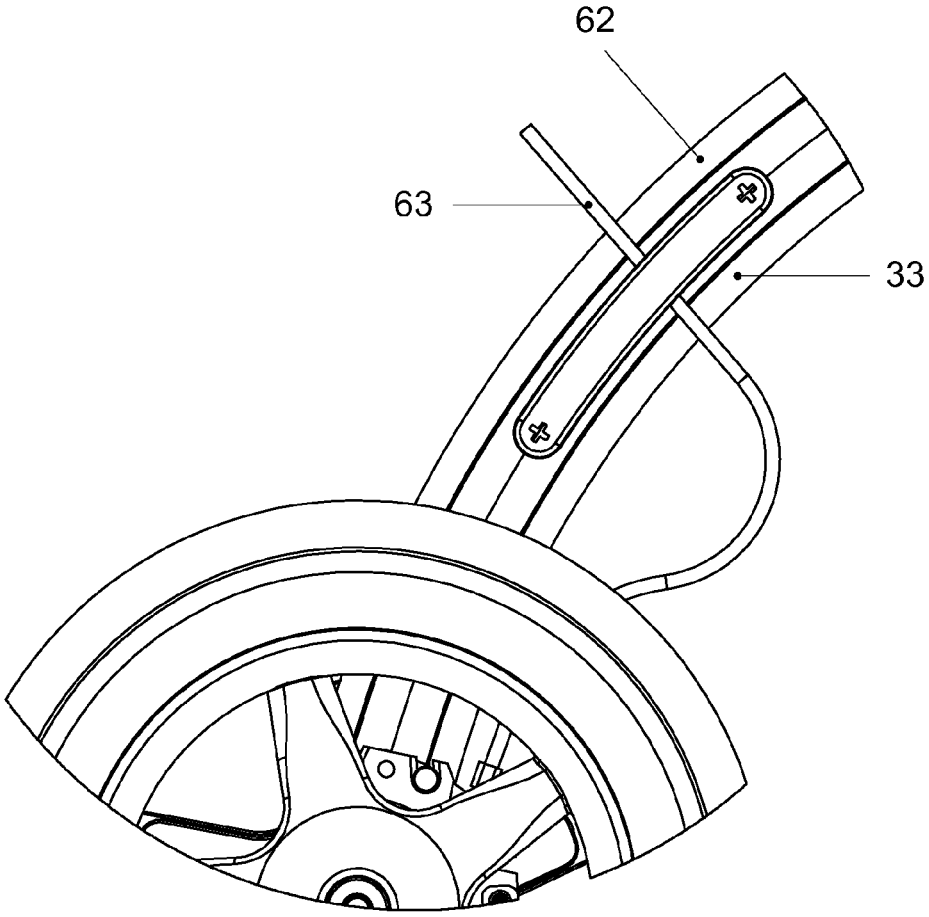
FIG. 17 is a cut-out side view of a rear wheel and profile section.
Figure 18:
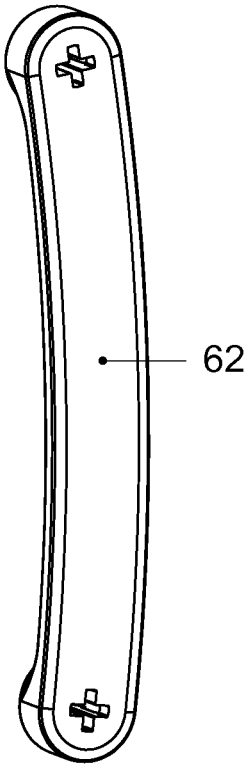
FIG. 18 is a perspective view of a brake cable holder.
Figure 19:
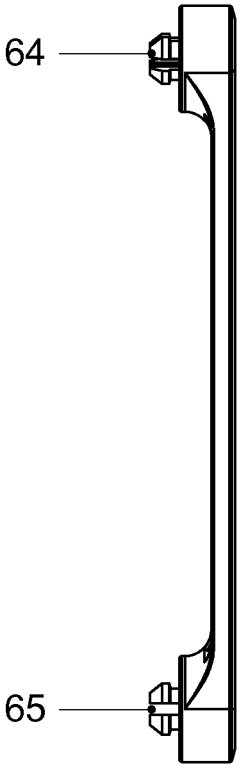
FIG. 19 is a side view of the brake cable holder of FIG. 18.

FIGS. 17, 18 and 19 show a holder 62 for a brake cable 63. The holder 62 is mounted on arm 33 of profile section 27 near rear wheel 5. The elongated holder 62 is provided with click-fingers 64, 65 protruding in a direction perpendicular to the longitudinal axis of the holder. For attachment to the arm 33, the arm 33 is provided with holes for receiving the click-fingers 64, 65. The size of the click-fingers 64, 65 is such that a confined space is clear between the holder and the arm 33. When the height the handle carrying the brake control (not shown) of the brake cable 63 is adapted, e.g. when the handle is rotated from one position to another, the brake cable 63 can move freely within the confined space.

While the invention has been illustrated and described in detail in the drawing and foregoing description, such illustration and description are to be considered illustrative or exemplary and not restrictive; the invention is not limited to the disclosed embodiments.

Other variations to the disclosed embodiments can be understood and effected by those skilled in the art in practicing the claimed invention, from a study of the drawings, the disclosure, and the appended claims.

The invention claimed is:

1. A rollator wheelchair, comprising a frame provided with at least two wheels, a first chair section provided on the frame and a second chair section provided on the frame, the first chair section comprising a back support and a first seat portion;

the second chair section comprises a second seat portion, wherein the first chair section and the second chair section together provide a seating position, wherein the first chair section is detachable from the frame; and wherein the second chair section is provided on the frame such that with a detached first chair section a free walking space is present between the at least two wheels.

2. A rollator wheelchair according to claim 1, wherein the frame further comprises:

two similar shaped profile sections spaced apart at a mutual distance, symmetrically with respect to a central plane, in-between which two swivelling arms are crosswise arranged;

wherein the profile sections each comprise three arms, which are respectively provided in a mounting place for a front wheel, a rear wheel and a handle;

wherein the profile sections are each provided with a hinge and a catching stop, wherein each swivel arm at one end is allied respectively by means of a hinge of one of the two profile sections and at an other end on the catch point of an other of the two profile sections rests; and whereby the swivel arms in the central plane are mutually connected by means of a connection hinge; and wherein the second chair section is foldable.

3. A rollator wheelchair according to claim 2, wherein the profile sections comprise at least one hollow portion, wherein the at least one hollow portion comprises at least a closed mounting groove and at least a stop ridge that is connected to the mounting groove.

4. A rollator wheelchair according to claim 2, further comprising at least one footrest, wherein the footrest comprises an attachment element and an arm provided with a board;

wherein the attachment element comprises two jaw members that are operable by a pressing mechanism and that may be pressed toward each other by operation of the pressing mechanism;

wherein the inner sides of the jaw members are adapted to the circumference of the profile sections; and wherein each jaw member is provided with two recesses for receiving a pin.

5. A rollator wheelchair according to claim 1, further comprising two handles, wherein each handle is provided on a rod provided with a clamp ring for adjusting the height of the handles.

6. A rollator wheelchair according to claim 2, further comprising an elongated brake cable provided with two click-fingers for the connection at a distance on one of the two profile sections.

* * * * *